US011745938B2

(12) United States Patent
Zhou et al.

(10) Patent No.: US 11,745,938 B2
(45) Date of Patent: Sep. 5, 2023

(54) REEFER CONTAINER

(71) Applicants: China International Marine Containers (Group) Ltd., Guangdong (CN); CIMC Vehicles Group Co., LTD., Guangdong (CN); Qingdao CIMC Reefer Trailer CO., LTD., Jiaozhou (CN)

(72) Inventors: Niancheng Zhou, Jiaozhou (CN); Yan Xu, Jiaozhou (CN); Xiaoyi Wang, Jiaozhou (CN); Xinan Ding, Jiaozhou (CN); Yelong Ning, Jiaozhou (CN)

(73) Assignees: China International Marine Containers (Group) Ltd., Shenzhen (CN); CIMC Vehicles Group Co., LTD., Shenzhen (CN); Qingdao CIMC Reefer Trailer CO., LTD., Jiaozhou (CN)

( * ) Notice: Subject to any disclaimer, the term of this patent is extended or adjusted under 35 U.S.C. 154(b) by 116 days.

(21) Appl. No.: 17/152,532

(22) Filed: Jan. 19, 2021

(65) Prior Publication Data

US 2022/0048703 A1 Feb. 17, 2022

(30) Foreign Application Priority Data

Aug. 11, 2020 (CN) ..... 202010801216.3

(51) Int. Cl.
*B65D 88/12* (2006.01)
*B65D 90/08* (2006.01)

(52) U.S. Cl.
CPC ..... *B65D 88/121* (2013.01); *B65D 90/08* (2013.01)

(58) Field of Classification Search
CPC .. B65D 88/121; B65D 90/08; B65D 90/0026; B65D 90/02; B65D 90/04; B65D 90/041; B65D 90/042; B65D 90/043
See application file for complete search history.

(56) References Cited

U.S. PATENT DOCUMENTS 3,515,303 A * 6/1970 Hannah ..... B65D 90/06 220/592.25
3,515,503 A * 6/1970 Mihelick ..... F04B 53/00 417/415
7,288,192 B2 * 10/2007 Jowett ..... C02F 3/10 220/23.91

(Continued)

*Primary Examiner* — Don M Anderson
(74) *Attorney, Agent, or Firm* — Mei & Mark LLP

(57) ABSTRACT

The present invention provides a reefer container transported in components including a bottom panel sheet assembly, two side panel sheet assemblies, a top panel sheet assembly, a front wall sheet assembly, and a rear wall sheet assembly. The components are assembled into a closed hexahedral box. The inner side of the side panel sheet assembly and the inner side of the top panel sheet assembly each have an inner lining board. The inner lining boards are integrally formed and abut against each other in the box. Each sheet assembly has an integral foam insulation layer smooth the inner surface of the inner lining board and reduce the scratch damage of the inner lining board from goods; reducing the box's maintenance costs and frequency. There are also no splicing seams on the inner lining board, preventing moisture from entering the insulation layer and improving the service life of the reefer container.

7 Claims, 7 Drawing Sheets

(56) References Cited

U.S. PATENT DOCUMENTS

| | | | | |
|---|---|---|---|---|
| 11,167,915 | B1 * | 11/2021 | Ford, III | E04H 1/1238 |
| 2012/0011785 | A1 * | 1/2012 | Kulas | B65D 90/02 52/177 |
| 2014/0224791 | A1 * | 8/2014 | Downey | B65D 90/10 228/178 |
| 2019/0275963 | A1 * | 9/2019 | LaRocco | B60R 13/0861 |
| 2021/0237638 | A1 * | 8/2021 | Moore | B60P 7/0815 |
| 2022/0089226 | A1 * | 3/2022 | Henning | B62D 27/06 |

* cited by examiner

REEFER CONTAINER

TECHNICAL FIELD

The invention relates to the technical field of transportation containers, in particular to a reefer container.

BACKGROUND

As an advanced transportation method, the container transportation has the irreplaceable advantages over other transportation methods, and it has become one of the most important transportation methods widely used in the world due to its high efficiency, convenience and safety. The development of shipping containers over the years has brought a drastic change to international trade. At present, the specifications for shipping containers mainly include 20-foot containers, 40-foot containers and 45-foot containers. Containers not only can carry out ocean transportation, but also can be easily transported on roads or railways. North America has first developed a 53-foot inland container for inland transportation in North America in accordance with relevant road regulations.

At present, the production of 53-foot reefer containers has the following two modes. One mode is that the container manufacturer builds a factory near the customer to complete the production and assembly of the entire box and directly deliver it to the customer; the other mode is that the container manufacturer builds a factory in a different place to complete the production of each component, and to assemble them at the destination to facilitate transportation and to save transportation costs.

In the prior art, when traditional reefer containers are transported in the form of loose parts, the top sheet and the side sheet are both in multi-section structure. When the reefer containers are assembled at the destination, large amount of assembly workload consumes a lot of manpower and material resources. After assembly, patch welding is required inside of the box as the goods will easily scratch damage the inner of the lining board due to the multiple visible splicing gaps and exposed raised fasteners formed inside the box.

SUMMARY

The purpose of the present invention is to provide a reefer container, which is convenient to assemble at the destination, and to ensure the smoothness of the inside of the box and reduce the scratch damage of the inner lining board from the goods.

To solve the above technical problems, the present invention adopts the following technical solutions:

According to one aspect of the present invention, the present invention provides a reefer container, comprising a bottom panel sheet assembly, two side panel sheet assemblies, a top panel sheet assembly, a front wall sheet assembly, and a rear wall sheet assembly that are transported in the form of loose parts, wherein each sheet assembly is able to enclose together to form a closed hexahedral box; wherein each of the inner sides of both side and top panel sheet assemblies have an inner lining board, wherein each inner lining board is integrally formed and sequentially abut against each other in the box; wherein each of the bottom panel sheet assembly, top panel sheet assembly, and the two side panel sheet assemblies has an integral foaming insulation layer.

In some embodiments, the top panel sheet assembly has a middle frame lintel board, both of the sheet assemblies have a middle frame column, and the bottom panel sheet assembly has a middle frame beam, wherein the middle frame lintel board, the middle frame column and the middle frame beam are arranged correspondingly to enclose the outer side of the box.

In some embodiments, the side panel sheet assembly further comprises a vertically-arranged side wall board, located on the outer side corresponding to the inner lining boards, wherein the middle frame column is vertically-arranged and fixedly connected to the side wall board, wherein the side panel sheet assembly is integrally connected, and the foam is formed together, and wherein an insulation layer is formed between the side wall boards and the corresponding inner lining board.

In some embodiments, tracks are arranged correspondingly on the inner sides of the inner lining boards of the two side panel sheet assemblies, and wherein the track is an integrated structure and extends along the length direction of the side panel sheet assembly, wherein the projection of the middle frame column on the inner lining board of the side panel sheet assemblies are intersected with the track.

In some embodiments, the inner surface of the inner lining board of the side panel sheet assembly is recessed outward to form an installation groove and the track is contained in the installation groove.

In some embodiments, the bottom panel sheet assembly further comprises an upper floor, a lower floor and a supporting structure, and the lower floor is fixedly connected below the upper floor and is arranged apart from the upper floor, wherein the supporting structure is arranged at the bottom of the lower floor, wherein the middle frame beam is fixed to the bottom of the supporting structure, wherein the bottom panel sheet assembly is integrally connected and the foam is formed together, and wherein the insulation layer is correspondingly formed between the upper floor and the lower floor.

In some embodiments, the bottom panel sheet assembly further comprises an isolation rib, wherein the isolation rib is located at an interval between the upper floor and the lower floor and is connected to the upper floor by fasteners.

In some embodiments, the supporting structure comprises a bottom cross beam, a front wall subassembly and a rear wall subassembly, wherein the bottom cross beam, the front wall subassembly and the rear wall subassembly are fixed to the bottom surface of the lower floor, wherein the front wall subassembly and the rear wall subassembly are respectively arranged at both ends of the lower floor, and are able to connect to the front wall sheet assembly and the rear wall respectively, wherein the bottom cross beam is located between the front wall subassembly and the rear wall subassembly.

In some embodiments, a plurality of the isolation ribs are longitudinally distributed, wherein each of the bottom cross beam, the front wall subassembly and the rear wall subassembly are connected to the corresponding isolation rib by the fasteners passing through the lower floor.

In some embodiments, the bottom panel sheet assembly further comprises a bottom corner fitting, and the middle frame beam is fixed to the bottom surface of the front wall subassembly and the rear wall subassembly, respectively, and is spaced from the two longitudinal ends of the lower floor, wherein the bottom corner fitting is fixed to the two ends of the middle frame beam and extends transversally outward beyond the supporting structure.

In some embodiments, the top panel sheet assembly further comprises a top wall board and a top corner fitting, wherein the top wall board and the corresponding inner lining board are arranged at an interval, wherein the middle frame lintel board is fixed on the upper surface of the top wall board and is spaced apart from the two longitudinal ends of the top wall board, wherein the top corner fitting are fixedly connected to the middle frame lintel board or the top wall board, and extends into the interval between the top wall board and the corresponding inner lining board, wherein the top panel sheet assembly is integrally installed and then the foam is formed together, and wherein the insulation layer is formed between the top wall board and the corresponding inner lining board.

In some embodiments, a notch is opened between the top wall board and the corresponding insulation layer, and the notch is spaced from the two longitudinal ends of the top wall board, wherein the top corner fitting comprises a box body and a connecting body is surrounding and connected to the outer periphery of the box, wherein a hollow bolt cavity is formed between the connecting body and the box body, wherein the box body is provided in the notch and extends transversally outward from the notch, wherein the connecting body is located outside the notch and connected to the middle frame lintel board, wherein a long hole is opened on the connecting body.

In some embodiments, the box comprises a first accommodating part and a second accommodating part that are connected transitionally in the transversal direction, wherein the outer side of the second accommodating part is connected to the connecting body, the second accommodating part is located outside the notch, and the first accommodating part is connected to the inner side of the second accommodating part and extends into the notch, wherein the bottom end of the first accommodating part is higher than the bottom end of the second accommodating part, and a step is formed on the bottom surface of the box body.

By means of the above technical solutions, the reefer container provided by the technical solutions of the present invention has at least the following advantages and positive effects:

The reefer container includes a bottom panel sheet assembly, two side panel sheet assemblies, a top panel sheet assembly, a front wall sheet assembly, and a rear wall sheet assembly that are transported in the form of loose parts. Each sheet assembly is produced in a different place and is assembled into a single integral part to facilitate transportation, and up-down handling during transportation.

Each sheet assembly can be enclosed together to form a closed hexahedral box; each sheet assembly is a single integral structure. When the reefer containers are assembled at the destination, the assembly workload is small, and convenient, which save up the manpower and material resources, and improve the economic efficiency.

The inner side of the side and top panel sheet assembly are provided with the inner lining boards. The inner lining boards are all integrally formed in boards. A single inner lining board does not have splicing seams. The inner lining boards sequentially abut against each other in the box, making the inner surface of the inner lining board relatively smooth, and effectively reduce the scratch damage of the inner lining board from the goods in order to reduce the frequency and cost of the maintenance of the box. At the same time, there are no splicing seams on the inner lining board, which effectively prevents moisture from entering the insulation layer by passing through the inner lining board, ensuring the performance of the insulation layer, and thus effectively improving the service life of the reefer container.

Figure 1:
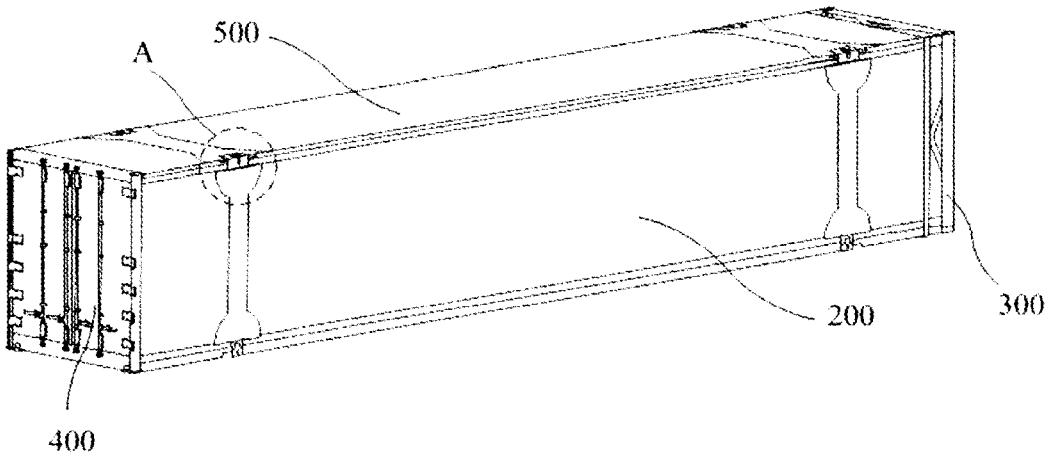
FIG. 1 is a three-dimensional schematic structural view of an embodiment of the reefer container of the invention.

The reference signs are explained as follows:

100, Bottom panel sheet assembly; 110, Upper floor; 111, Water channel; 120, Lower floor; 130, Insulation layer; 140, Supporting structure; 141, Bottom cross beam; 142, Front wall subassembly; 143, Rear wall subassembly; 150, Isolation rib; 151. Fastener; 152. Fastener; 160, Middle frame beam; 170, Bottom corner fittings;

200, Side panel sheet assembly; 210, Side wall board; 211, Top side beam; 212, Bottom side beam; 213, Installation port; 220, Inner lining board; 221, Installation slot; 230, Insulation layer; 240, Middle frame column; 250, Track;

300, Front wall sheet assembly; 400, Rear wall sheet assembly;

500, Top panel sheet assembly; 510, Top wall board; 520, Inner lining board; 530, Insulation layer; 540, Middle frame lintel board; 550, Top corner fitting; 551, Box body; 5511, First accommodating part; 5512, Second accommodating part; 552, Connecting body; 5521, First connecting board; 5522, Second connecting board; 5523, Long hole; 553, Hollow bolt cavity.

DETAILED DESCRIPTION

Typical embodiments reflecting the features and advantages of the present invention will be described in detail in the following description. The present invention can have various changes in different embodiments, which do not depart from the scope of the present invention, and the descriptions and diagrams therein are essentially for illustrative purposes, rather than limiting this invention.

In the description of the application, the orientation or positional relationship that indicated by the terms "center", "longitudinal", "transversal", "length", "width", "thickness", "upper", "lower", "front", "rear", "left", "right", "vertical", "horizontal", "top", "bottom", "inner", "outer", "clockwise", "counterclockwise" are based on the orientation or positional relationship shown in the drawings, and is only for the convenience of explaining the application and simplifying the description, and does not indicate or imply that the device or element referred to must have a specific orientation or be constructed and operated in a specific orientation, therefore, it cannot be understood as a restriction on this application. In addition, the terms "first" and "second" are only used for descriptive purposes, and do not indicate or imply relative importance or implicitly indicate the number of technical features. Therefore, the features defined with "first" and "second" may explicitly or implicitly include one or more of the features. In the description of the present application, "a plurality of" means two or more than two, unless otherwise specifically defined.

Figure 2:
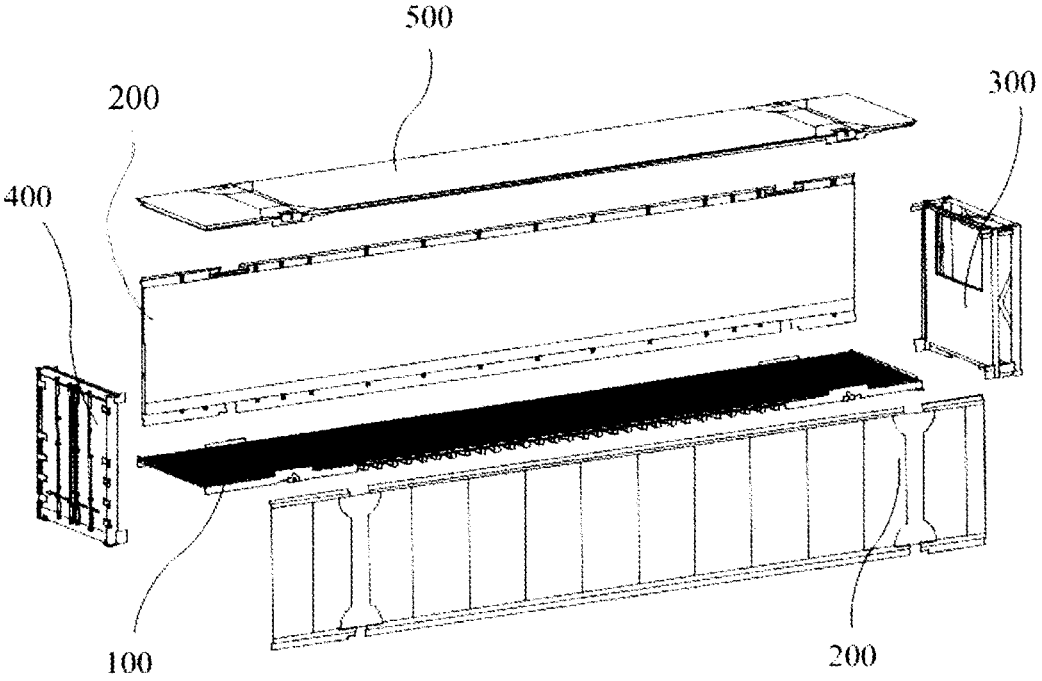
FIG. 2 is an exploded schematic structural view of an embodiment of the reefer container of the invention.

FIG. 1 is a three-dimensional schematic structural view of an embodiment of the reefer container of the invention. FIG. 2 is an exploded schematic structural view of an embodiment of the reefer container of the invention.

Referring to FIG. 1 and FIG. 2, the embodiment provides a container, which includes a bottom panel sheet assembly 100, two side panel sheet assemblies 200, a front wall sheet assembly 300, a rear wall sheet assembly 400, and a top panel sheet assembly 500. The bottom panel sheet assembly 100, the side panel sheet assemblies 200, the front wall sheet assembly 300, the rear wall sheet assembly 400, and the top panel sheet assembly 500 are enclosed to form a closed hexahedral box.

The bottom panel sheet assembly 100, the side panel sheet assemblies 200, the front wall sheet assembly 300, the rear wall sheet assembly 400, and the top panel sheet assembly 500 of the container are transported in the form of loose parts. A single sheet assembly is a whole. The six pieces are transported to the destination and assembled to form a complete container.

The following example shows the structure of the container assembly. The usage state of the container is used as a reference in the following when describing the front, rear, upper, lower, top, bottom, side, inner, and outer directions.

There are two side panel sheet assemblies 200, which are erected on both sides of the bottom panel sheet assembly 100, and the bottom ends of the side panel sheet assemblies 200 are attached and fixed to the transversal sides of the bottom panel sheet assembly 100.

The front wall sheet assembly 300 and the rear wall sheet assembly 400 are respectively arranged at both longitudinal ends of the bottom panel sheet assembly 100. Both the front wall sheet assembly 300 and the rear wall sheet assembly 400 are connected to the ends of the bottom panel sheet assembly 100 and the side panel sheet assemblies 200.

The top panel sheet assembly 500 covers the upper part of each of the side panel sheet assemblies 200, the front wall sheet assembly 300, and the rear wall sheet assembly 400.

Figure 3:
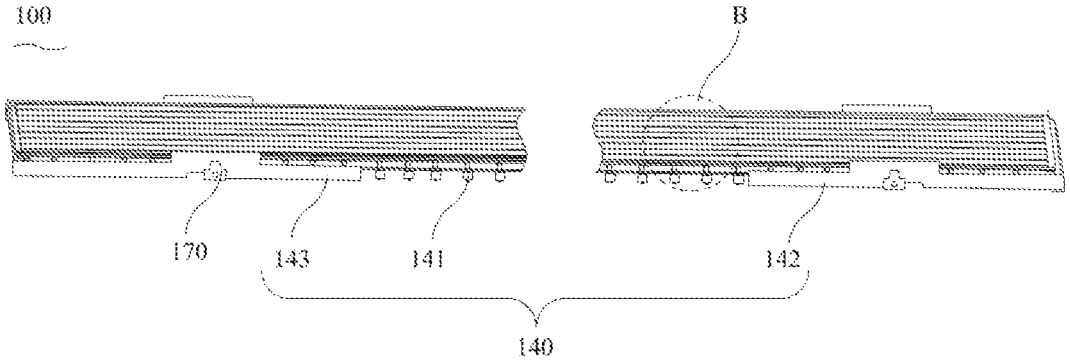
FIG. 3 is a schematic structural view of the bottom panel sheet assembly viewed from a perspective in the embodiment of the reefer container of the invention.
Figure 4:
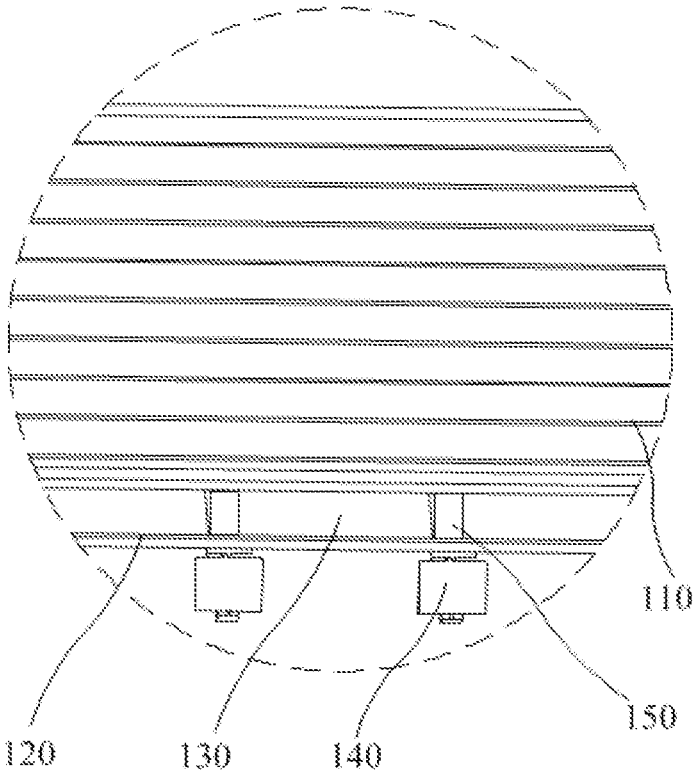
FIG. 4 is an enlarged view of Section B in FIG. 3.
Figure 5:
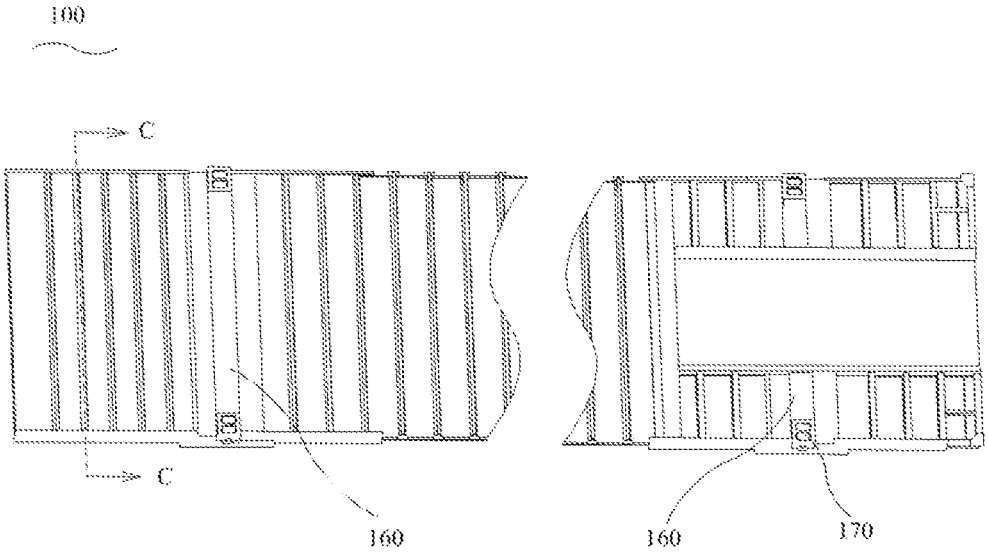
FIG. 5 is a schematic structural view of the bottom panel sheet assembly viewed from another perspective in the embodiment of the reefer container of the invention.
Figure 6:
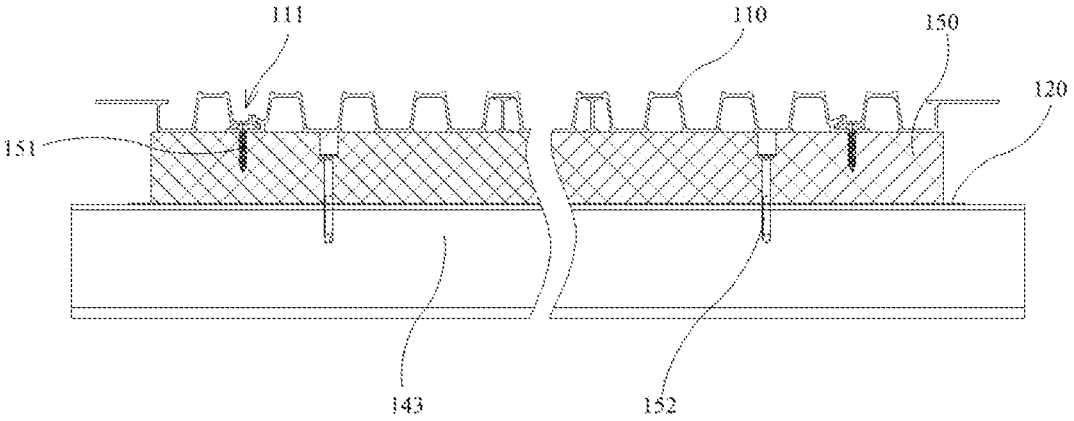
FIG. 6 is a cross-sectional view at C-C in FIG. 5.

FIG. 3 is a schematic structural view of the bottom panel sheet assembly viewed from a perspective in the embodiment of the reefer container of the invention. FIG. 4 is an enlarged view of Section B in FIG. 3. FIG. 5 is a schematic structural view of the bottom panel sheet assembly viewed from another perspective in the embodiment of the reefer container of the invention. FIG. 6 is a cross-sectional view at C-C in FIG. 5.

As shown in FIGS. 3 to 6, the bottom panel sheet assembly 100 is arranged transversally, and the bottom panel sheet assembly 100 comprises an upper floor 110, a lower floor 120, an insulation layer 130, and a supporting structure 140. The upper floor 110 and the lower floor 120 are vertically spaced apart, the insulation layer 130 is formed between the upper floor 110 and the lower floor 120, and the supporting structure 140 is arranged at the bottom of the lower floor 120.

In this embodiment, the upper end of the upper floor 110 has a concave-convex structure, and a water channel 111 is formed. The upper floor 110 is made of aluminum.

An isolation rib 150 is arranged at an interval between the upper floor 110 and the lower floor 120, the isolation rib 150 is fixedly connected to the upper floor 110, and the upper end of the isolation rib 150 is attached to the bottom surface of the upper floor 110. The isolation rib 150 extends in the transversal direction, and multiple isolation ribs are distributed in multiple longitudinal directions.

The isolation rib 150 and the upper floor 110 are connected by fasteners 151 to connect the isolation rib 150 and the upper floor 110 together. There are multiple fasteners 151 installed on each isolation rib 150 along the length direction.

In this embodiment, the fastener 151 is a self-tapping screw. The fastener 151 passes down through the upper floor 110 from the water channel 111 of the upper floor 110 and is in threaded connection with the isolation rib 150. The upper end of the fastener 151 is located in the water channel 111 and is lower than the top surface of the upper floor 110, and the fastener 151 will not interfere with the items in the container.

A counterbore (not shown in the figure) is provided on the upper surface of the isolation rib 150, and a fastener 152 is provided in the counterbore. The support structure 140 is connected to the isolation rib 150 through the fastener 152 penetrating the lower floor 120, and the lower floor 120 is clamped between the support structure 140 and the isolation rib 150 so that the lower floor 120 connects below the upper floor 110.

The counterbore on the isolation rib 150 is arranged so that the fastener 152 will not protrude from the upper surface of the isolation rib 150 and will not interfere with the attachment of the isolation rib 150 and the upper floor 110.

A plurality of fasteners 152 are distributed along the transversal direction on each isolation rib 150, and the fasteners 152 and the fasteners 151 are installed in the transversal direction.

The supporting structure 140 comprises a bottom cross beam 141, a front wall subassembly 142 and a rear wall subassembly 143. The bottom cross beam 141, the front wall subassembly 142, and the rear wall subassembly 143 are all fixed to the bottom surface of the lower floor 120 by fasteners 152.

The front wall subassembly 142 and the rear wall subassembly 143 are arranged at both ends of the lower floor 120, and the bottom cross beam 141 is located between the front wall subassembly 142 and the rear wall subassembly 143. Specifically, the front wall subassembly 142 is located at the front end of the bottom cross beam 141 to connect to the front wall sheet assembly 300. The rear wall subassembly 143 is located at the rear end of the bottom cross beam 141 to connect to the rear wall sheet assembly 400.

The bottom cross beam 141 comprises two connecting boards arranged at intervals and a plurality of connecting beams vertically connected between the two connecting boards. In this embodiment, there are a plurality of connecting beams, and both ends of each connecting beam are connected to a connecting board. In some embodiments, there are a plurality of connecting beams, and the ends of the plurality of connecting beams are connected to the same connecting board.

The length direction of the connecting beams connecting to the bottom cross beam 141 are arranged transversally, and the plurality of connecting beams connecting to the bottom cross beam 141 are arranged at intervals along the longitudinal direction. After passing through the lower floor 120, the fastener 152 is in threaded connection with the corresponding connecting beam on the bottom cross beam 141. After the container is installed, the connecting board of the bottom cross beam 141 is attached to the inner side of the bottom end of a side panel sheet assembly 200.

The rear wall subassembly 143 comprises two bottom side beams arranged at intervals and a plurality of connecting beams vertically connected between the two bottom side beams. The connecting beams are arranged transversally in the length direction, and the plurality of connecting beams connected to the rear wall subassembly 143 are arranged along the longitudinal interval. After passing through the lower floor 120, the fastener 152 is in threaded connection with the corresponding connecting beam on the rear wall subassembly 143. After the container is installed, the bottom side beam of the rear wall subassembly 143 is attached to the corresponding structure on the rear wall sheet assembly 400.

The front wall subassembly 142 comprises two bottom side beams arranged at intervals and a plurality of connecting beams vertically connected between the two bottom side beams. The connecting beams are arranged transversally in the length direction, and the plurality of connecting beams of the front wall subassembly 142 are arranged at intervals along the longitudinal direction. After passing through the lower floor 120, the fastener 152 is in threaded connection with the corresponding connecting beam on the front wall subassembly 142. After the container is installed, the bottom side beam of the front wall subassembly 142 is attached to the corresponding structure on the front wall sheet assembly 300.

Each connecting beam of the front wall subassembly 142 is broken in the middle of the longitudinal direction, and a gooseneck groove is formed to adapt to the installation and fixation of the frame.

In the embodiment, the bottom side beams of the bottom cross beam 141, the front wall subassembly 142 and the rear wall subassembly 143 are all made of I-beam. In some embodiments, the connecting beam is made of a square tube.

In this embodiment, the bottom side beams of the rear wall subassembly 143 and the front wall subassembly 142 are made of bent boards, and the bottom side beam includes a horizontal part horizontally arranged and fixedly connected to the bottom of the connecting beam and a vertical part extending upward from the outer end of the horizontal part.

The bottom panel sheet assembly 100 further comprises a middle frame cross beam 160 and a bottom corner fitting 170. The middle frame cross beam 160 is fixed to the bottom of the supporting structure 140. The length direction of the middle frame cross beam 160 is arranged in the transversal direction, and the bottom corner fittings 170 are fixed to both ends of the middle frame cross beam 160 in the transversal direction.

In this embodiment, two middle frame beams 160 are provided, and the two middle frame beams 160 are respectively fixed to the bottom surfaces of the front wall subassembly 142 and the rear wall subassembly 143. The middle frame cross beam 160 which is fixed to the front wall subassemblies 142 is provided with a corresponding broken part corresponding to the gooseneck groove of the front wall subassembly 142.

The bottom corner fittings 170 are fixed to the two ends of the middle frame cross beam 160 and extend beyond the supporting structure 140 in the transversal direction.

The middle frame cross beam 160 is spaced longitudinally from both ends of the upper floor 110 or the lower floor 120 in the longitudinal direction, so that the bottom corner fitting 170 is spaced from both ends of the upper floor 110 or the lower floor 120 in the longitudinal direction. Specifically, in this embodiment, taking a 53-foot container as an example, two bottom corner fittings 170 are provided on each transversal side of the upper floor 110 or the lower floor 120, and two bottom corner fittings 170 on the same side are arranged symmetrically with respect to the longitudinal center plane of the upper floor 110 or the lower floor 120, and the center distance of the two bottom corner fittings 170 is 40 feet. The center distance between the two middle frame beams 160 is also 40 feet.

In this embodiment, the upper floor 110, the lower floor 120, the supporting structure 140, the isolation rib 150, the middle frame beam 160 and the bottom corner fitting 170 of the bottom panel sheet assembly 100 are integrally fixed and welded together, and the bottom panel sheet assembly 100 is integrally connected and foamed together, and an insulation layer 130 is formed between the upper floor 110 and the lower floor 120.

The bottom panel sheet assembly 100 is transported as a whole after integrally foamed and installed as a whole at the destination.

In this embodiment, the fasteners 151 and the fasteners 152 are both self-tapping screws to facilitate installation and save the step of drilling holes. At the same time the connection becomes tighter.

In some embodiments, both the fastener 151 and the fastener 152 are bolts or screws, and the corresponding bottom side beam and the isolation rib 150 are pre-punched for the connection and fixation of the fastener 151 and the fastener 152.

Figure 7:
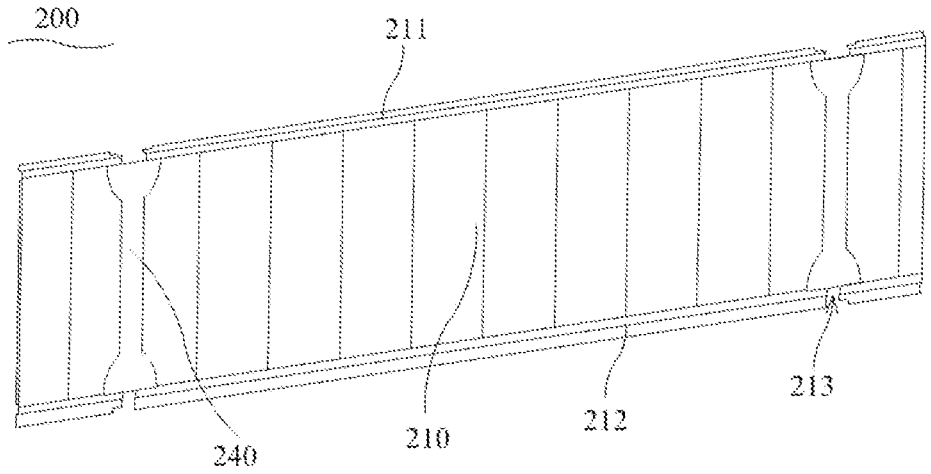
FIG. 7 is a schematic structural view of the side panel sheet assembly viewed from a perspective in the embodiment of the reefer container of the invention.
Figure 8:
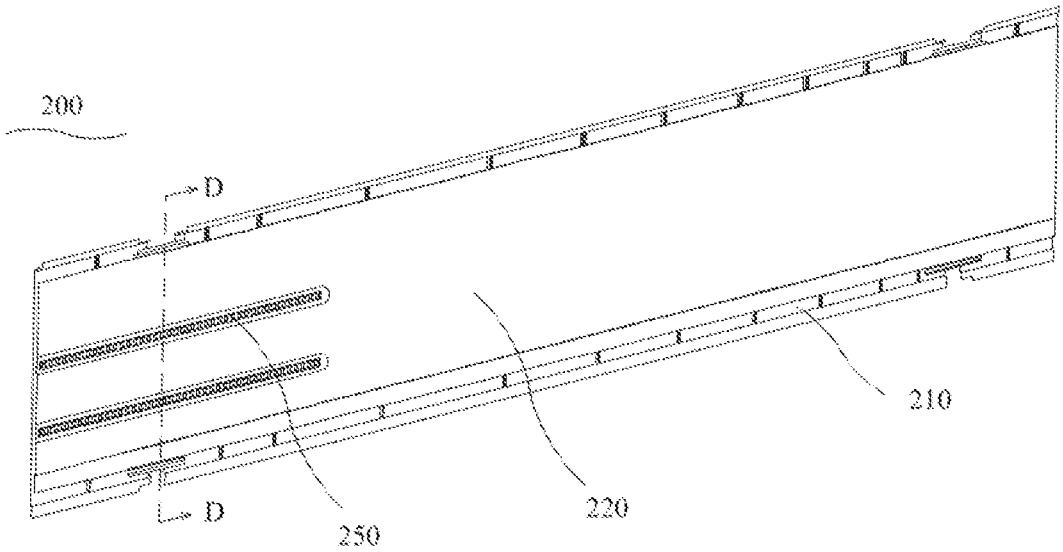
FIG. 8 is a schematic structural view of the side panel sheet assembly viewed from another perspective in the embodiment of the reefer container of the invention.
Figure 9:
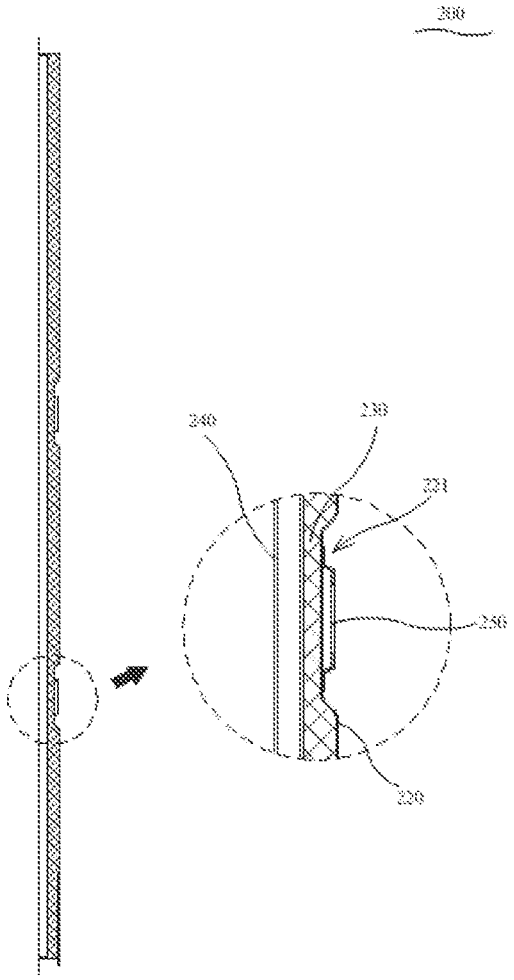
FIG. 9 is a cross-sectional view at D-D in FIG. 8.

FIG. 7 is a schematic structural view of a side panel sheet assembly viewed from a perspective in the embodiment of the reefer container of the invention. FIG. 8 is a schematic structural view of a side panel sheet assembly viewed from another perspective in the embodiment of the reefer container of the invention. FIG. 9 is a cross-sectional view at D-D in FIG. 8.

Referring to FIGS. 7 to 9, the side panel sheet assemblies 200 are vertically arranged, and each side panel sheet assembly 200 comprises a side wall board 210, an inner lining board 220, an insulation layer 230 and a middle frame column 240. The side wall board 210, the insulation layer 230, and the inner lining board 220 are arranged sequentially, and the side wall board 210 is located outside the inner lining board 220.

The side wall board 210 is vertically arranged, and the upper and lower ends of the side wall board 210 extend beyond the inner lining board 220 to form a top side beam 211 and a bottom side beam 212 respectively. After the container is assembled, the inner sides of the top side beams 211 of the two side wall boards 210 are attached to the transversal sides of the top panel sheet assembly 500 respectively. The inner sides of the bottom side beams 212 of the two side wall boards 210 are attached to the transversal sides of the bottom panel sheet assembly 100 respectively.

The middle frame column 240 is vertically arranged and fixedly connected to the side wall board 210. In this embodiment, the middle frame column 240 is a board structure and is welded to the outer surface of the side wall board 210. The upper and lower ends of the middle frame column 240 extend to connect to the top side beam 211 and the bottom side beam 212 respectively.

The width of the upper and lower ends of the middle frame column 240 is greater than the width of the middle part, so that when a side panel sheet assembly 200 is stressed by the bottom panel sheet assembly 100 at the bottom end or by the top panel sheet assembly 500 at the top end, the stress is dispersed on the middle frame column 240, to ensure that the side panel sheet assembly 200 is not easily deformed.

In this embodiment, the middle frame column 240 is hot-dip galvanized to enhance the structural performance of the middle frame column 240. The middle frame column 240 is welded to the outer side of the side wall board 210 to withstand the frequent scratches of container handling equipment to the maximum extent and protect the side wall board 210

The middle frame column 240 is longitudinally spaced from the two longitudinal ends of the side wall board 210. Specifically, in this embodiment, taking a 53-foot container as an example, two middle frame columns 240 are symmetrically arranged with respect to the longitudinal center plane of the side wall board 210, and the center distance of the two middle frame columns 240 is 40 feet.

In the embodiment, both the top side beam 211 and the bottom side beam 212 are provided with installation ports 213. The installation port 213 of the top side beam 211 penetrates upward to the upper edge of the top side beam 211, and penetrates through the wall thickness of the top side beam 211. The installation port 213 of the bottom side beam 212 penetrates upward to the upper edge of the top side beam 212, and penetrates through the wall thickness of the bottom side beam 212.

The installation ports 213 of the top side beam 211 and the bottom side beam 212 are arranged corresponding to the middle frame column 240 and are located directly above and below the middle frame column 240. The installation port 213 of the bottom side beam 212 is used to fit with the bottom corner fitting 170 on the bottom panel sheet assembly 100 and is used to place the bottom corner fitting 170. The installation port 213 on the top side beam 211 is used to fit with the corresponding structure on the top panel sheet assembly 500.

The inner lining board 220 is vertically arranged, and the inner lining board 220 is an integrated board. The inner lining board 220 is integrally forged or die-casted. The lower end of the inner lining board 220 is connected to the upper floor 110 of the bottom panel sheet assembly 100, and the upper end of the inner lining board 220 is connected to the corresponding position of the top panel sheet assembly 500. The longitudinal two ends of the inner lining board 220 are respectively butted against the front wall sheet assembly 300 and the rear wall sheet assembly 400.

The inner lining board 220 is an integrated board, and the inner lining board 220 has no splicing joint to ensure the relative smoothness of the surface of the inner lining board 220, in order to reduce the scratch damage to the inner lining board 220 during loading and unloading. Potential internal leaks are reduced, and it can effectively avoid water from entering the insulation layer 230 through the inner lining board 220 and ensure the insulation performance and service life of the insulation layer 230. Product performance is improved and is more beautiful.

The inner side of the inner lining board 220 is concave outward to form an installation slot 221, which extends longitudinally. The projection of the middle frame column 240 on the inner lining board 220 of a side panel sheet assembly 200 intersects with the installation slot 221. That is, the installation slot 221 is continuous on the inner lining board 220, and the installation slot 221 has no splicing joint in the length extension direction.

The installation slots 221 are correspondingly arranged on the two inner lining boards 220 of the two side panel sheet assemblies 200 and tracks 250 are correspondingly arranged on the installation slots 221 of the inner lining boards 220 of the two side panel sheet assemblies 200.

After the container is installed, a supporting frame (not shown in the figure) is installed on the corresponding track 250 of the two inner lining boards 220, and the two ends of the supporting frame are supported on the two corresponding tracks 250 to place articles on the supporting frame.

A plurality of track holes (not shown in the figure) are distributed longitudinally on the track 250 for positioning and fixing the supporting frame.

In the embodiment, the track 250 can be received in the installation slot 221, so that the track 250 does not protrude from the inner surface of the inner lining board 220, and the track 250 will not interfere with the goods.

In this embodiment, the projection of the middle frame column 240 on the inner lining board 220 of the side panel sheet assembly 200 intersects with the transversal projection of the track 250, that is, the track 250 is an integrated formed whole structure, and the track 250 has no splicing joint so the installation and welding are convenient.

In the embodiment, two tracks 250 are arranged on the inner lining board 220 of each side panel sheet assembly 200, and the two tracks 250 are arranged in parallel and extend along the longitudinal direction. In some embodiments, two or more than two tracks 250 are arranged on the inner lining board 220 of each side panel sheet assembly 200.

In the embodiment, the side wall board 210, the inner lining board 220, the middle frame column 240 and the track 250 of each side panel sheet assembly 200 are integrally fixed and welded together, and then the side panel sheet assembly 200 is integrally connected and foamed together, and an insulation layer 230 is formed between the side wall board 210 and the inner lining board 220.

The side panel sheet assembly 200 is integrally foamed and transported as a whole and installed as a whole piece at the destination.

Figure 10:
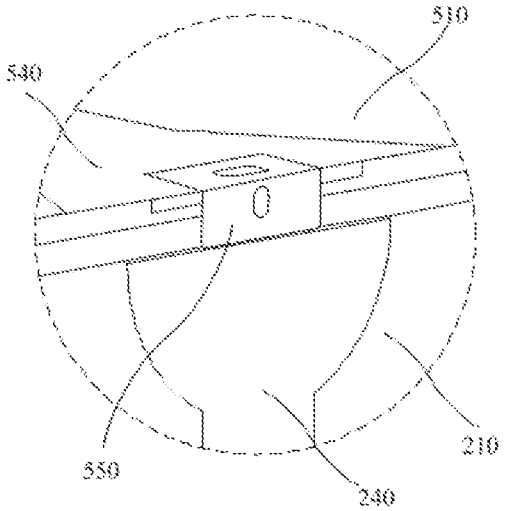
FIG. 10 is an enlarged view of Section A in FIG. 1.
Figure 11:
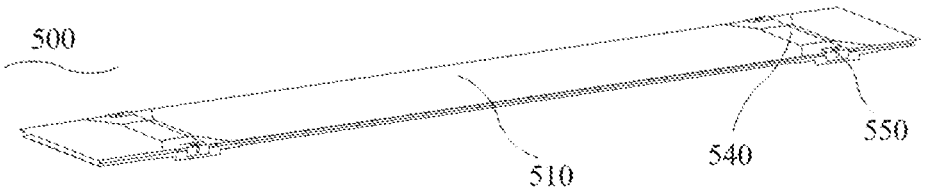
FIG. 11 is a schematic structural view of the top panel sheet assembly in the embodiment of the reefer container of the invention.
Figure 12:
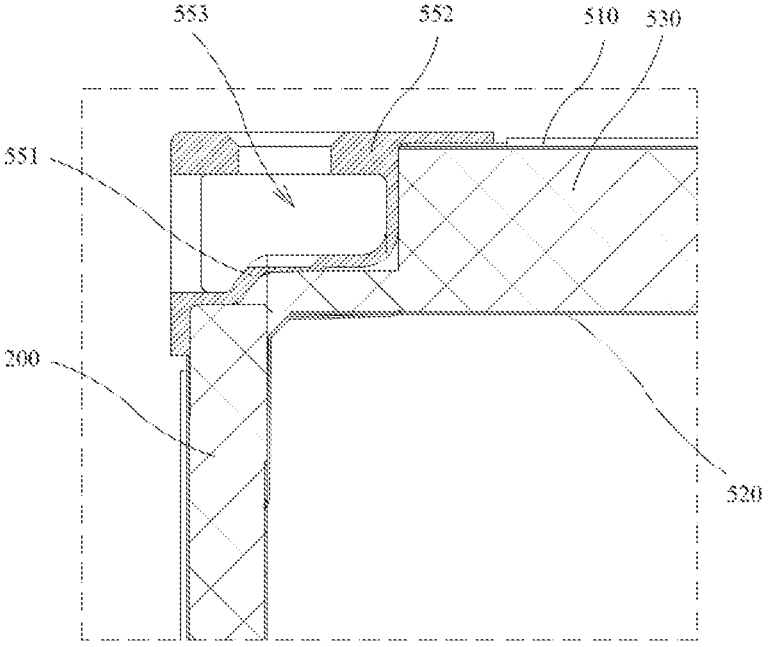
FIG. 12 is a partial cross-sectional view of the embodiment of the reefer container of the invention.
Figure 13:
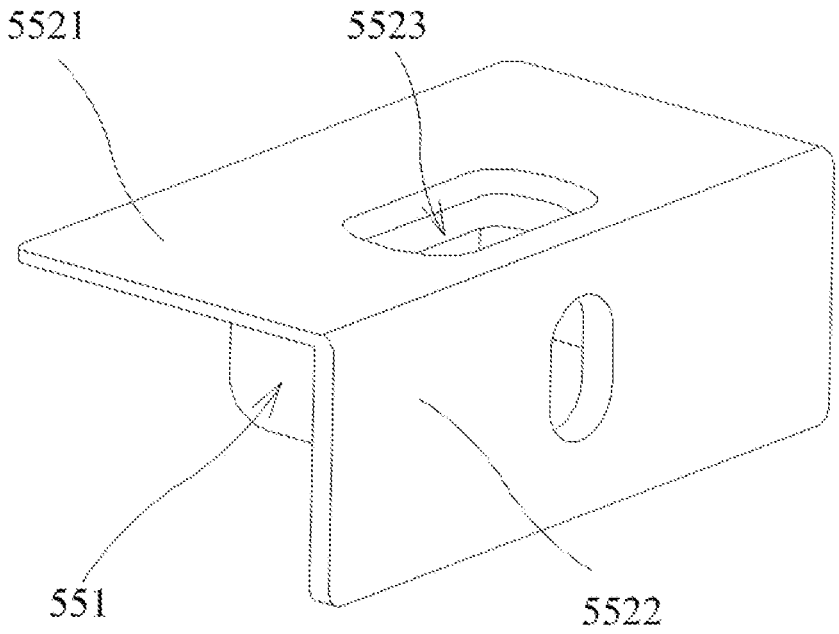
FIG. 13 is a schematic structural view of the top corner fitting viewed from a perspective in the embodiment of the reefer container of the invention.
Figure 14:
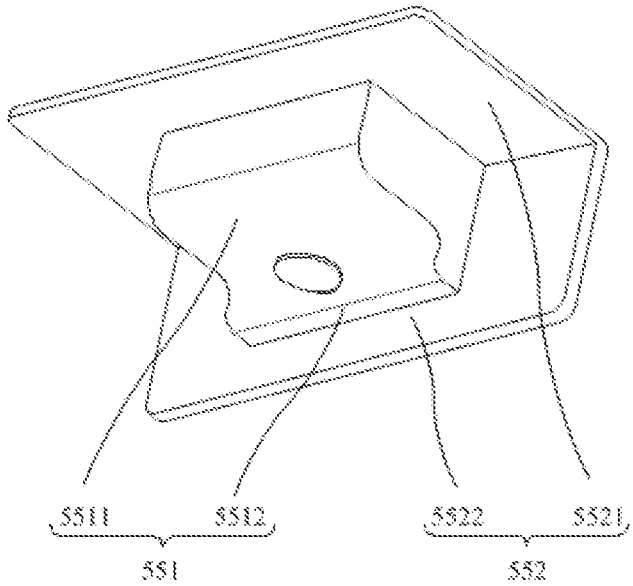
FIG. 14 is a schematic structural view of the top corner fitting viewed from another perspective in the embodiment of the reefer container of the invention.

FIG. 10 is an enlarged view of Section A in FIG. 1. FIG. 11 is a schematic structural view of the top panel sheet assembly in the embodiment of the reefer container of the invention. FIG. 12 is a partial cross-sectional view of the embodiment of the reefer container of the invention. FIG. 13 is a schematic structural view of the top corner fitting viewed from a perspective in the embodiment of the reefer container of the invention. FIG. 14 is a schematic structural view of the top corner fitting viewed from another perspective in the embodiment of the reefer container of the invention.

Referring to FIGS. 10 to 14, the top panel sheet assembly 500 is arranged horizontally, and each top panel sheet assembly 500 comprises a top wall board 510, an inner lining board 520, an insulation layer 530, a middle frame lintel board 540 and a top corner fitting 550. The top wall board 510, the insulation layer 530, and the inner lining board 520 are arranged in sequence, and the top wall board 510 is located outside of the inner lining board 520. The top wall board 510 and the inner lining board 520 are arranged at an interval, and the insulation layer 530 is formed at an interval between the top wall board 510 and the inner lining board 520.

After the container is installed, the two longitudinal ends of the top panel sheet assembly 500 are respectively butted against the front wall sheet assembly 300 and the rear wall sheet assembly 400, and the two transversal sides of the top panel sheet assembly 500 are butted against the side panel sheet assembly 200.

The middle frame lintel board 540 is horizontally arranged and fixedly connected to the top wall board 510. In the embodiment, the middle frame lintel board 540 is in a board structure and is welded to the upper surface of the side wall board 210. The two transversal ends of the middle frame lintel board 540 extend to the two transversal ends of the top wall board 510 respectively.

The width of the two transversal ends of the middle frame lintel board 540 is greater than the width of the middle part, so that when the top panel sheet assembly 500 is stressed by the side panel sheet assembly at the bottom end, the stress is dispersed on the middle frame lintel board 540, so as to effectively ensure that the top panel sheet assembly 500 is not easily deformed.

The middle frame lintel board 540 is longitudinally spaced from the two longitudinal ends of the top wall board 510. Specifically, in this embodiment, taking a 53-foot container as an example, two middle frame lintel boards 540 are symmetrically arranged with respect to the longitudinal center plane of the top wall board 510, and the center distance of the two middle frame lintel boards 540 is 40 feet.

The inner lining board 520 of the top panel sheet assembly 500 is vertically arranged, and the inner lining board 520 is an integral formed board. The inner lining board 520 is integrally forged or die-casted, and the two transversal ends of the inner lining board 520 are respectively butted with the upper end of the inner lining board 220 of the side panel sheet assembly 200. The two longitudinal ends of the inner lining board 520 are respectively butted against the front wall sheet assembly 300 and the rear wall sheet assembly 400.

The inner lining board 520 is an integral formed board, and there are no cracks and splicing joints in the inner lining board 520 to ensure the relative smoothness of the surface of the inner lining board 520 to reduce the scratch damage to the inner lining board 520 during loading and unloading. Potential internal leaks are reduced, and it can effectively avoid water from entering the insulation layer 530 through the inner lining board 520, and to ensure the insulation performance and service life of the insulation layer 530, which improved the performance and appearance of the product.

There is a notch (not shown in the figure) between the top wall board 510 and the corresponding insulation layer 530. The notch is opened on the upper surface of the top wall board 510 and opens upwardly and outwardly. Specifically, the notch is opened on both sides of the transversal direction of the top wall board 510.

The notch is longitudinally spaced from the longitudinal two ends of the top wall board 510, specifically the notch corresponds to the middle frame lintel board 540. In the embodiment, taking a 53-foot container as an example, two notches are arranged on one transversal side face of each top panel sheet assembly 500. The two notches on the same side face are symmetrically arranged on the longitudinal central plane of the top panel sheet assembly 500, and the center distance between the two notches is 40 feet.

The notch on the top panel sheet assembly 500 corresponds to the installation port 213 on the side panel sheet assembly 200, so that the notch connects to the installation port 213 on the side panel sheet assembly 200, to form an accommodating cavity which opens toward the outside of the container at the connection of the side panel sheet assembly 200 and the top panel sheet assembly 500, and is matched with the top corner fitting 550.

After the container is installed, the top corner fitting 550 is connected to the top wall board 510 and the side panel sheet assembly 200. The top corner fitting 550 is arranged corresponding to each notch, and a top corner fitting 550 is correspondingly arranged in each notch, so that a plurality of top corner fittings 550 arranged on both sides of the transversal direction of the top wall board 510.

In the embodiment, the top corner fitting 550 comprises a box body 551 and a connecting body 552 surrounding and connected to the periphery of the box body 551. The box body 551 is accommodated in the cavity formed at the connection of the side panel sheet assembly 200 and the top panel sheet assembly 500. The connecting body 552 is fixedly connected to the top wall board 510 and the side wall board 210. Specifically, the connecting body 552 is fixedly connected the top side beam 211 and the top wall board 510 on the side wall board 210. The top corner fitting 550 is welded by multiple parts or integrated casting.

In the embodiment, the connecting body 552 comprises a first connecting board 5521 and a second connecting board 5522 vertically connected outside the first connecting board 5521. The first connecting board 5521 is parallel to the upper surface of the top wall board 510, and the box body 551 is connected to the lower side surface of the first connecting board 5521 and the inner surface of the second connecting board 5522.

In the embodiment, the first connecting board 5521 is welded to the upper surface of the middle frame lintel board 540 and the top wall board 510, and closes the upper end of the notch on the top panel sheet assembly 500 and the upper end of the installation port 213 on the side panel sheet assembly 200. Each of the first connecting board 5521 and the second connecting board 5522 is provided with a long hole 5523. The long hole 5523 is used for the bolt of the external wristlock to pass through.

The connecting body 552 and the box body 551 are enclosed to form a hollow bolt cavity 553. Specifically, the upper end of the box body 551 and the end connected to the second connecting board 5522 are both openings, and the box body 551 is connected to the first connecting board 5521 and the second connecting board 5522 to form the hollow bolt cavity 553.

When lifting or stacking a container, the bolt of the wristlock passes through the long hole 5523, and the bolt rotates in the hollow bolt cavity 553, so that the bolt of the wristlock is stuck by the inner wall of the connecting body 552.

The box body 551 comprises a first accommodating part 5511 and a second accommodating part 5512 which are connected transversely. The upper ends of the first accommodating part 5511 and the second accommodating part 5512 are both connected to the lower surface of the first connecting board 5521; one side of the second accommodating part 5512 in the transversal direction is connected to the inner surface of the second connecting board 5522 and the other side of the second accommodating part 5512 in the transversal direction is connected to the first accommodating part 5511.

The second accommodating part 5512 is located outside the notch of the top panel sheet assembly 500. Specifically, the second accommodating part 5512 is contained in the installation port 213 of the side panel sheet assembly 200, and the first accommodating part 5511 is connected to the inner side of the second accommodating part 5512 and extends into the notch of the top panel sheet assembly 500. The box body 551 is partially contained in the notch of the top panel sheet assembly 500 and extends outwards from the notch in the transversal direction.

In this embodiment, the first connecting board 5521 is welded on the upper surface of the middle frame lintel board 540 and the top wall board 510, the second connecting board 5522 is welded on the outer side of the side wall board 210, and the first accommodating part 5511 is contained in the notch and extends out the notch. The second accommodating part 5512 is located at the end of the first accommodating part 5511 extending out of the notch. The lower end of the top corner fitting 550 does not protrude into the box of the container to ensure the effective volume of the box and to avoid the impact of the goods effectively.

In some embodiments, the second connecting board 5522 is fixed on the outer side face of the side wall board 210 through fasteners or other connection methods.

In the embodiment, the bottom end of the first accommodating part 5511 is higher than the bottom end of the second accommodating part 5512, to form a step on the bottom surface of the box body 551.

The step arranged between the first accommodating part 5511 and the second accommodating part 5512 does not affect the fit of the bolt of the wristlock and the top corner fitting 550. After passing through the long hole 5523 on the first connecting board 5521 or the second connecting board 5522, the bolt reaches a certain depth in the hollow bolt cavity 553 of the top corner fitting 550, and rotates in the hollow bolt cavity 553 to ensure the fit of the bolt of the wristlock and the top corner fitting 550.

The arrangement of steps between the first accommodating part 5511 and the second accommodating part 5512 ensures that the first accommodating part 5511 has a smaller vertical thickness on the basis of ensuring the fit of the wristlock and the top corner fitting 550, to prevent the box body 551 from extending into the box of the container from the lower surface of the top panel sheet assembly 500.

In the embodiment, both the first connecting board 5521 and the second connecting board 5522 extend out of the box body 551 along the longitudinal direction, the end of the first connecting board 5521 deviating from the second connecting board 5522 exceeds the box body 551, and the end of the second connecting board 5522 deviating from the first connecting board 5521 exceeds the box body 551. The first connecting board 5521 and the second connecting board 5522 have larger coverage area and welding area on the top panel sheet assembly 500 and the side panel sheet assembly 200 to form a larger protection area for the surrounding area of the box body 551 of the container, to provide a larger anti-collision area, and to reduce the probability of damage to the container.

At the same time, the stress of top corner fitting 550 on the container is more dispersed. To avoid the stress concentration, the load borne by top corner fitting 550 is more evenly distributed to the box, which improves the reliability of the box and makes the welding structure more stable and reliable.

Each middle frame lintel board 540 is connected between the two top corner fittings 550 in the transversal direction to disperse the stress of the top corner fitting 550 to the middle frame lintel board 540 to enhance the strength of the top panel sheet assembly 500, and to avoid the local deformation of the top panel sheet assembly 500 at the top corner fitting 550.

In an exemplary embodiment, the container is a North American inland 53 foot reefer container, and the structure of the top panel sheet assembly in the embodiment is also applicable to other refrigerated, insulated, dry cargo containers or cabinets with other length and containing a middle frame structure.

The top corner fitting 550 comprises a box body 551 and a connecting body 552 surrounding and connected to the periphery of the box body 551, the box body 551 is contained in the notch and extends out of the notch in the transversal direction; the connecting body 552 is located outside the notch. After the container is assembled, the box body 551 will not protrude into the box from the lower surface of the top panel sheet assembly 500, and the box body 551 and the connecting body 552 are both located outside the space in the box, ensuring that the top corner fitting 550 does not protrude into the box of the container to ensure the effective volume of the box and to improve the appearance of the space in the box; and to avoid the impact of goods.

In the embodiment, the top wall board 510, the inner lining board 520, the middle frame lintel board 540 and the top corner fitting 550 of each top panel sheet assembly 500 are integrally fixed and welded together, and then the top panel sheet assembly 500 is integrally connected and foamed together, and an insulation layer 530 is formed between the top wall board 510 and the inner lining board 520.

The top panel sheet assembly 500 is integrally foamed and transported as a whole and installed as a whole at the destination.

In the embodiment, the middle frame lintel board 540, the middle frame column 240 and the middle frame cross beam 160 are arranged correspondingly to surround outside of the box correspondingly. The middle frame structure is constructed by the middle frame lintel board 540, the middle frame column 240 and the middle frame cross beam 160, to increase the strength of the box.

The middle frame structure is set to correspond to the top corner fitting 550 and the bottom corner fitting 170. Specifically, the top corner fitting 550 and the bottom corner fitting 170 are connected to the corresponding position of the middle frame structure, so that the stress on the top corner fitting 550 and the bottom corner fitting 170 is dispersed into the middle frame structure to reduce stress on the other structures of the box and prevent the box from deformation.

Referring to FIGS. 1 to 14, in the application, the reefer container comprises a bottom panel sheet assembly 100, two side panel sheet assemblies 200, a top panel sheet assembly 500, a front wall sheet assembly 300, and a rear wall sheet assembly 400 that are transported in the form of loose parts. Each sheet assembly is produced in a different place and is assembled into a single integral part to facilitate transportation and up-down handling during transportation.

Each sheet assembly can be enclosed together to form a closed hexahedral box; each sheet assembly is a single integral structure. When assembled at the destination, the assembly is convenient and the workload is small, which saves manpower and material resources, and improves economic efficiency.

Each of the inner sides of the side panel sheet assemblies 200 and the inner side of the top panel sheet assembly 500 is provided with the inner lining board. Each inner lining board is an integrally formed board. A single inner lining board does not have splicing seams. The inner lining boards sequentially abut against each other in the box, making the inner surface of the inner lining board relatively smooth reducing the scratch damage of the load to the inner lining board, and the frequency and cost of the maintenance of the box. At the same time, there are no splicing seams on the inner lining board, which prevents moisture from entering the insulation layer through the inner lining board, ensuring the performance of the insulation layer, and thus improving the service life of the reefer container.

While the application has been described with reference to several detail embodiments, the terms used are illustrative and exemplary rather than restrictive. Since the application can be implemented in various forms without departing from the spirit or essence of the application, the above-mentioned embodiments are not limited to any of the foregoing details, but should be widely interpreted within the spirit and scope defined by the accompanying claims. Therefore, all changes and modifications falling within the scope of the claims or their equivalent scope shall be covered by the accompanying claims.

What is claimed is:

1. A reefer container comprising a bottom panel sheet assembly, two side panel sheet assemblies, a top panel sheet assembly, a front wall sheet assembly, and a rear wall sheet assembly;

wherein each sheet assembly comprises a plurality of components configured to be fitted together;

wherein the sheet assemblies enclose together to form a closed hexahedral box;

wherein each of an inner side of the side panel sheet assembly and an inner side of the top panel sheet assembly has an inner lining board, and the inner lining boards are integrally formed boards and sequentially abut against each other in the box;

wherein each of the bottom panel sheet assembly, the top panel sheet assembly and the side panel sheet assembly has an integral foaming insulation layer;

wherein the top panel sheet assembly has a middle frame lintel board, each of the sheet assemblies have a middle frame column, and the bottom panel sheet assembly has a middle frame beam;

wherein the middle frame lintel board, the middle frame column and the middle frame beam are correspondingly arranged to correspondingly enclose on the outer side of the box;

wherein the side panel sheet assembly further comprises a side wall board vertically arranged, and located on the outer side corresponding to the inner lining boards, wherein the middle frame column is vertically arranged and fixedly connected to the side wall board, wherein the side panel sheet assembly is integrally connected and foamed together, and an insulation layer is correspondingly formed between the side wall boards and the corresponding inner lining board;

wherein a plurality of tracks are correspondingly arranged on the inner sides of the inner lining boards of the two side panel sheet assemblies, and each of the tracks is an integrated structure and extends along the length direction of the side panel sheet assembly, wherein the middle frame column on the inner lining board of the side panel sheet assemblies is perpendicular to the tracks; and wherein the inner surface of the inner lining board of the side panel sheet assembly is recessed outward to form an installation groove and the track is contained in the installation groove.

2. A reefer container comprising a bottom panel sheet assembly, two side panel sheet assemblies, a top panel sheet assembly, a front wall sheet assembly, and a rear wall sheet assembly;

wherein each sheet assembly comprises a plurality of components configured to be fitted together;

wherein the sheet assemblies enclose together to form a closed hexahedral box;

wherein each of an inner side of the side panel sheet assembly and an inner side of the top panel sheet assembly has an inner lining board, and the inner lining boards are integrally formed boards and sequentially abut against each other in the box; and wherein each of the bottom panel sheet assembly, the top panel sheet assembly and the side panel sheet assembly has an integral foaming insulation layer;

wherein the top panel sheet assembly has a middle frame lintel board, each of the sheet assemblies have a middle frame column, and the bottom panel sheet assembly has a middle frame beam; and wherein the middle frame lintel board, the middle frame column and the middle frame beam are correspondingly arranged to correspondingly enclose on the outer side of the box;

wherein the bottom panel sheet assembly further comprises an upper floor, a lower floor and a supporting structure, and the lower floor is fixedly connected below the upper floor and is arranged apart from the upper floor, wherein the supporting structure is arranged at the bottom of the lower floor, wherein the middle frame beam is fixed to the bottom of the supporting structure, wherein the bottom panel sheet assembly is integrally connected and foamed together, and the insulation layer is correspondingly formed between the upper floor and the lower floor;

wherein the bottom panel sheet assembly further comprises an isolation rib is located at an interval between the upper floor and the lower floor and is connected to the upper floor by fasteners; and wherein the supporting structure comprises a bottom cross beam, a front wall subassembly and a rear wall subassembly, wherein the bottom cross beam, the front wall subassembly and the rear wall subassembly are fixed to the bottom surface of the lower floor, wherein the front wall subassembly and the rear wall subassembly are respectively arranged at both ends of the lower floor, and able to connect to the front wall sheet assembly and the rear wall respectively, wherein the bottom cross beam is located between the front wall subassembly and the rear wall subassembly.

3. The reefer container according to claim 2, wherein a plurality of the isolation ribs are longitudinally distributed, wherein each of the bottom cross beam, the front wall subassembly and the rear wall subassembly is connected to the corresponding isolation rib by the fasteners passing through the lower floor.

4. The reefer container according to claim 3, wherein the bottom panel sheet assembly further comprises a bottom corner fitting, and the middle frame beam is fixed to the bottom surface of the front wall subassembly and the rear wall subassembly respectively, and is spaced from two longitudinal ends of the lower floor, wherein the bottom corner fitting is fixed to the two ends of the middle frame beam, and extends transversally outward beyond the supporting structure.

5. A reefer container comprising a bottom panel sheet assembly, two side panel sheet assemblies, a top panel sheet assembly, a front wall sheet assembly, and a rear wall sheet assembly;

wherein each sheet assembly comprises a plurality of components configured to be fitted together;

wherein the sheet assemblies enclose together to form a closed hexahedral box;

wherein each of an inner side of the side panel sheet assembly and an inner side of the top panel sheet assembly has an inner lining board, and the inner lining boards are integrally formed boards and sequentially abut against each other in the box;

wherein each of the bottom panel sheet assembly, the top panel sheet assembly and the side panel sheet assembly has an integral foaming insulation layer;

wherein the top panel sheet assembly has a middle frame lintel board, each of the sheet assemblies have a middle frame column, and the bottom panel sheet assembly has a middle frame beam; and wherein the middle frame lintel board, the middle frame column and the middle frame beam are correspondingly arranged to correspondingly enclose on the outer side of the box; and wherein the top panel sheet assembly further comprises a top wall board and a top corner fitting, wherein the top wall board and the corresponding inner lining board are arranged at an interval, wherein the middle frame lintel board is fixed on the upper surface of the top wall board and is spaced apart from the two longitudinal ends of the top wall board, wherein the top corner fitting are fixedly connected to the middle frame lintel board or the top wall board, and extends into the space between the top wall board and the corresponding inner lining board, wherein the top panel sheet assembly is integrally installed and the foam is formed together, and the insulation layer is correspondingly formed between the top wall board and the corresponding inner lining board.

6. The reefer container according to claim 5, wherein a notch is opened between the top wall board and the corresponding insulation layer, and the notch is spaced from the two longitudinal ends of the top wall board, wherein the top corner fitting comprises a box body and a connecting body surrounds and connects to the outer periphery of the box body, and a hollow bolt cavity is formed between the connecting body and the box body, wherein the box body is accommodated in the notch and extends transversally outward from the notch, wherein the connecting body is located outside the notch and connected to the middle frame lintel board, wherein a long hole is opened on the connecting body.

7. The reefer container according to claim 6, wherein the box body comprises a first accommodating part and a second accommodating part that are transitionally connected in the transversal direction, wherein the outer side of the second accommodating part is connected to the connecting body, the second accommodating part is located outside the notch, and the first accommodating part is connected to the inner side of the second accommodating part and extends into the notch, wherein the bottom end of the first accommodating part is higher than the bottom end of the second accommodating part, and a step is formed on the bottom surface of the box body.

* * * * *